US012428862B2

(12) United States Patent
Lynch

(10) Patent No.: US 12,428,862 B2
(45) Date of Patent: Sep. 30, 2025

(54) TILE REMOVAL ASSEMBLY

(71) Applicant: Dalton Lynch, Cedar Rapids, IA (US)

(72) Inventor: Dalton Lynch, Cedar Rapids, IA (US)

( * ) Notice: Subject to any disclaimer, the term of this patent is extended or adjusted under 35 U.S.C. 154(b) by 660 days.

(21) Appl. No.: 17/881,209

(22) Filed: Aug. 4, 2022

(65) Prior Publication Data

US 2024/0044159 A1 Feb. 8, 2024

(51) Int. Cl.
*E04G 23/08* (2006.01)

(52) U.S. Cl.
CPC ..... *E04G 23/082* (2013.01)

(58) Field of Classification Search
CPC ..... B25F 1/00; B25F 1/006; E04G 23/082; B66F 15/00; B25D 1/04; B25D 1/045
See application file for complete search history.

(56) References Cited

U.S. PATENT DOCUMENTS 977,986 A * 12/1910 Westley ..... B66F 15/00 254/131
1,030,660 A 6/1912 Hunt
1,561,647 A 11/1925 Johnson
2,330,092 A * 9/1943 Vanasse ..... B25F 1/00 254/26 R
3,604,028 A 9/1971 Wardwell
3,705,430 A 12/1972 Ziaylek, Jr.
7,438,279 B2 * 10/2008 Eby ..... B25D 1/045 81/20
D598,726 S 8/2009 Higgs
8,091,865 B2 * 1/2012 Eric ..... B66F 15/00 254/25
8,117,702 B2 * 2/2012 Woolley ..... E04G 23/082 7/138
10,793,410 B2 * 10/2020 Liou ..... B65G 7/02
11,142,921 B2 * 10/2021 Hile ..... B66F 15/00
11,565,925 B1 * 1/2023 Schuettpelz ..... B25D 1/045
11,858,790 B2 * 1/2024 Lenart ..... B25C 11/00
2004/0244545 A1 * 12/2004 Stinnissen ..... B25G 1/102 254/19
2014/0131644 A1 5/2014 Brown
2014/0182107 A1 * 7/2014 Nestor ..... B66F 15/00 254/131.5
2016/0052121 A1 * 2/2016 Smith ..... B66F 15/00 7/146
2024/0025025 A1 * 1/2024 Labbe ..... B25F 1/006

* cited by examiner

*Primary Examiner* — David B. Thomas

(57) ABSTRACT

A tile removal assembly includes a tool that has a handle and a head attached to the handle. The head has a claw portion extending laterally away from the handle and a chisel portion extending laterally away from the handle in an opposite direction from the claw portion. The claw portion has a thickness that is sufficiently thin to facilitate the claw portion to flex when the head is swung toward a tile is bonded to a hard floor surface. In this way the claw portion can travel between the tile and the hard floor surface to facilitate a user to drive the claw portion beneath the tile without requiring the user to swing the tool with a high degree of accuracy. The chisel portion has a thickness that is sufficiently thick to inhibit the chisel portion from flexing thereby facilitating the chisel portion to pry a fixed object.

7 Claims, 6 Drawing Sheets

TILE REMOVAL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tile removal devices and more particularly pertains to a new tile removal device for removing tiles from a hard floor surface. The device includes a handle and a head that is attached to the handle. The head has a claw portion and a chisel portion extending away from the handle in opposite directions with respect to each other. The claw portion has a thickness that is sufficiently thin to facilitate the claw portion to flex and the chisel portion has a thickness that is sufficiently thick to inhibit the chisel portion from flexing.

(2) Description of Related Art Including Information Disclosed Under 37 CFR 1.97 and 1.98

The prior art relates to tile removal devices including a tile removal tool that has an elongate handle, a grip oriented at an angle with the elongate handle and a pair of claws being spaced from the elongate handle. The prior art discloses a fireman's axe with has a spike oriented perpendicular to a handle and a claw which curves toward the handle. The prior art discloses a fireman's tool which includes a striking surface and a cutting edge. The prior art discloses a multi-purpose tool that includes a prying plate disposed on a first end of a handle and a head disposed on a second end of the handle which includes a claw extending laterally away from the head and a pick oriented collinear with the head. The prior art discloses a demolition tool that includes a prying element disposed on a first end of a handle and a head disposed on a second end of the handle. The head includes a striking surface and a pair of jaws. The prior art discloses an ornamental design for a hammer that combines a claw hammer and a crow bar.

BRIEF SUMMARY OF THE INVENTION

An embodiment of the disclosure meets the needs presented above by generally comprising a tool that has a handle and a head attached to the handle. The head has a claw portion extending laterally away from the handle and a chisel portion extending laterally away from the handle in an opposite direction from the claw portion. The claw portion has a thickness that is sufficiently thin to facilitate the claw portion to flex when the head is swung toward a tile is bonded to a hard floor surface. In this way the claw portion can travel between the tile and the hard floor surface to facilitate a user to drive the claw portion beneath the tile without requiring the user to swing the tool with a high degree of accuracy. The chisel portion has a thickness that is sufficiently thick to inhibit the chisel portion from flexing thereby facilitating the chisel portion to pry a fixed object.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
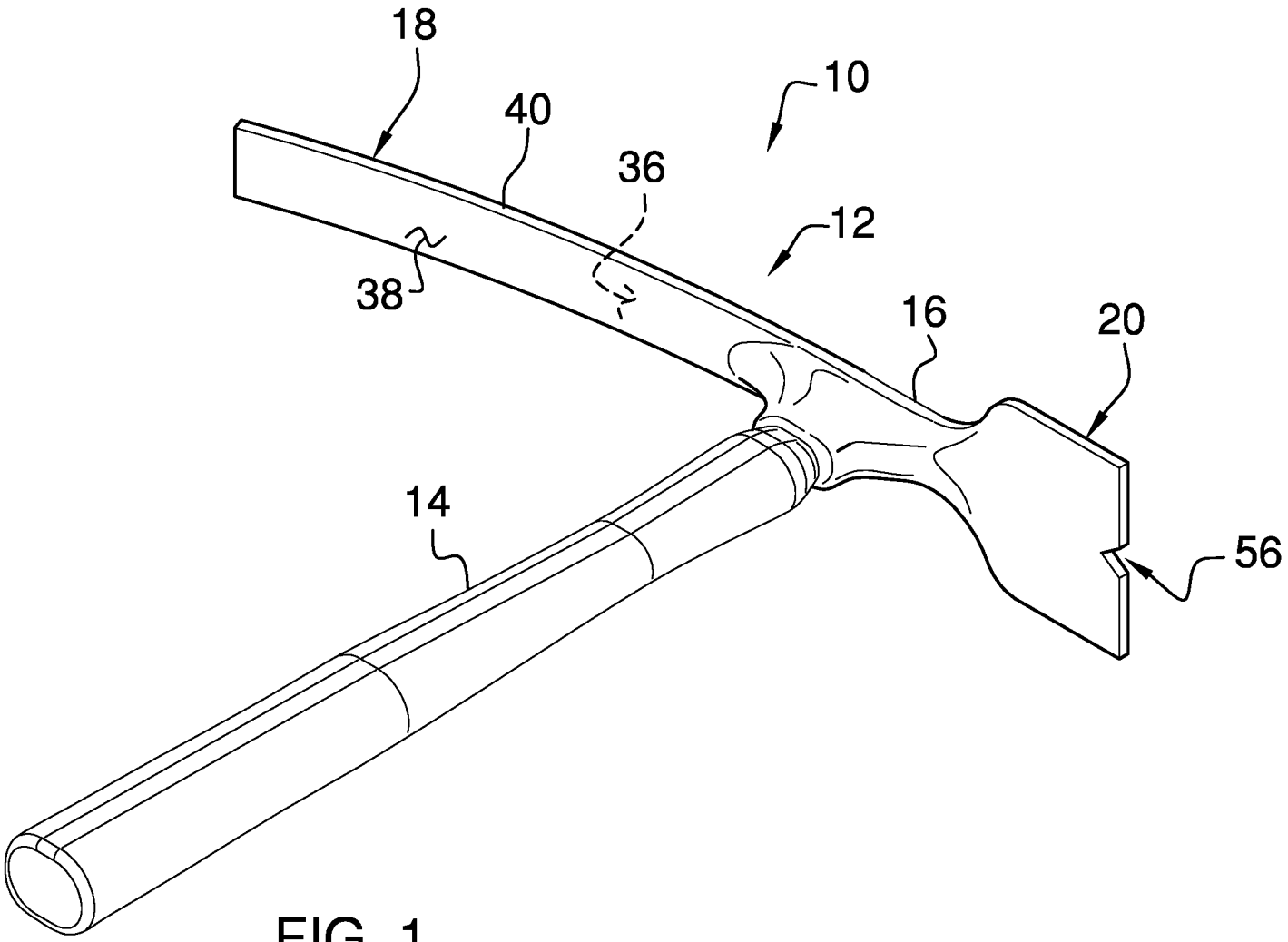
FIG. 1 is a perspective view of a tile removal assembly according to an embodiment of the disclosure.
Figure 2:
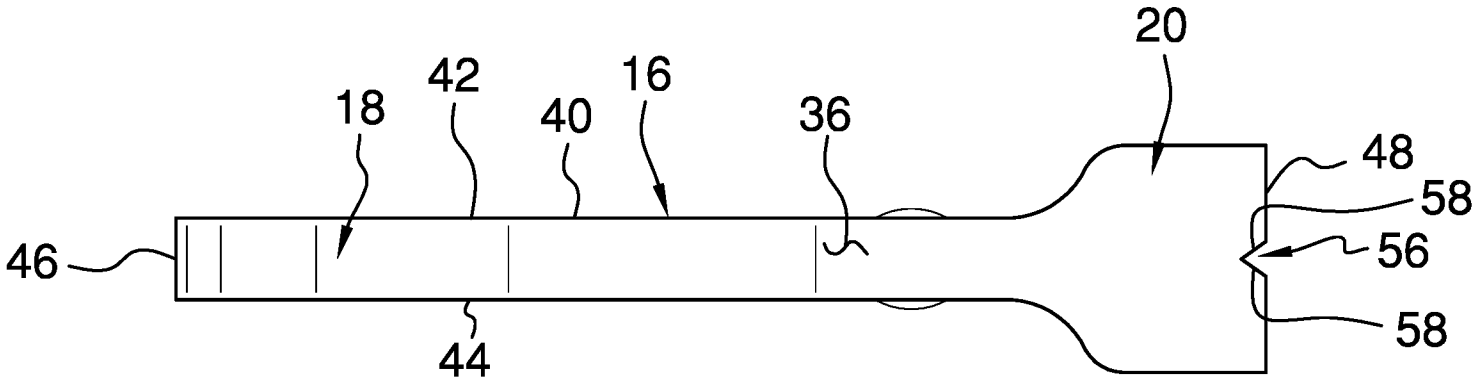
FIG. 2 is a top view of an embodiment of the disclosure.
Figure 3:
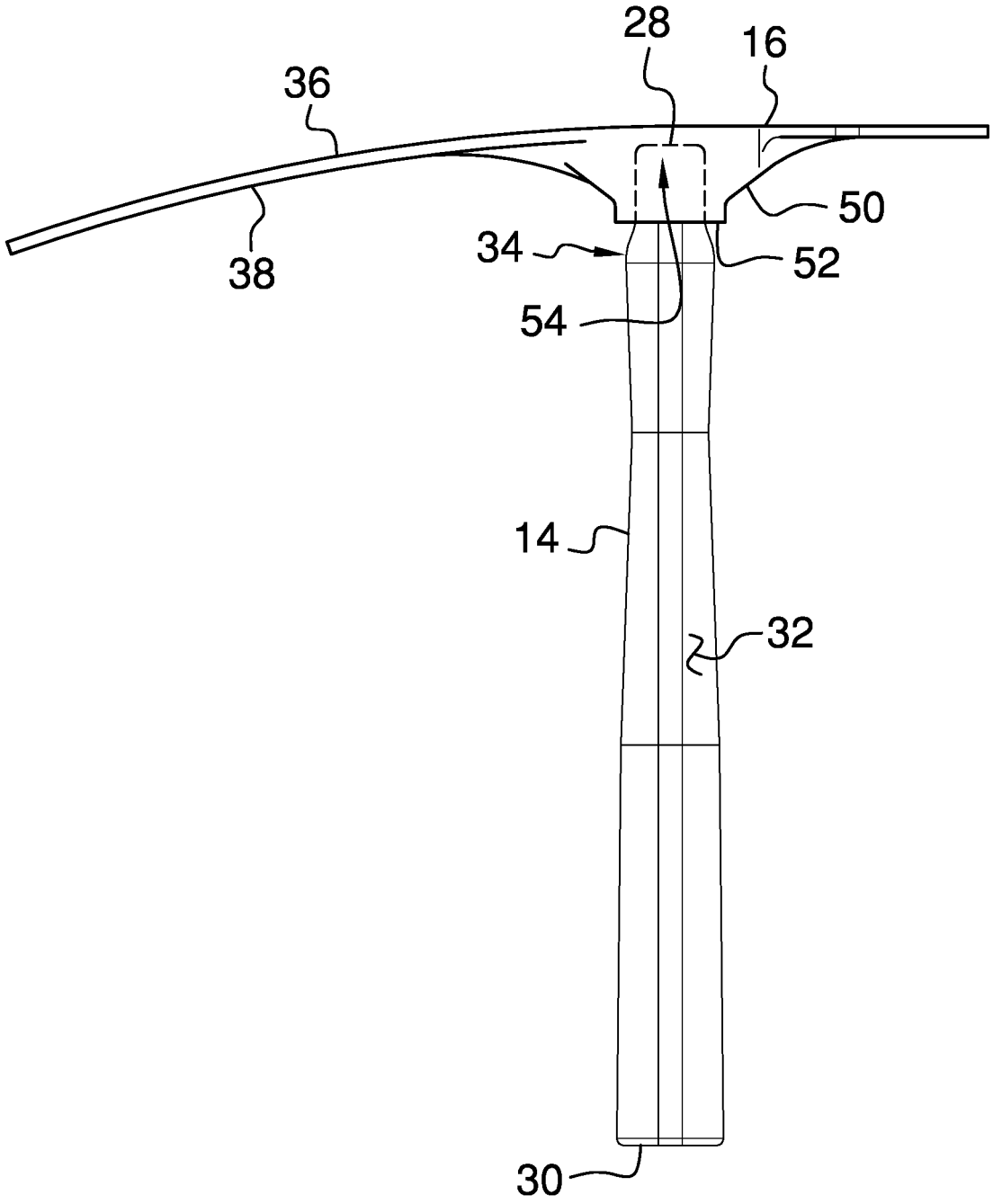
FIG. 3 is a right side view of an embodiment of the disclosure.
Figure 4:
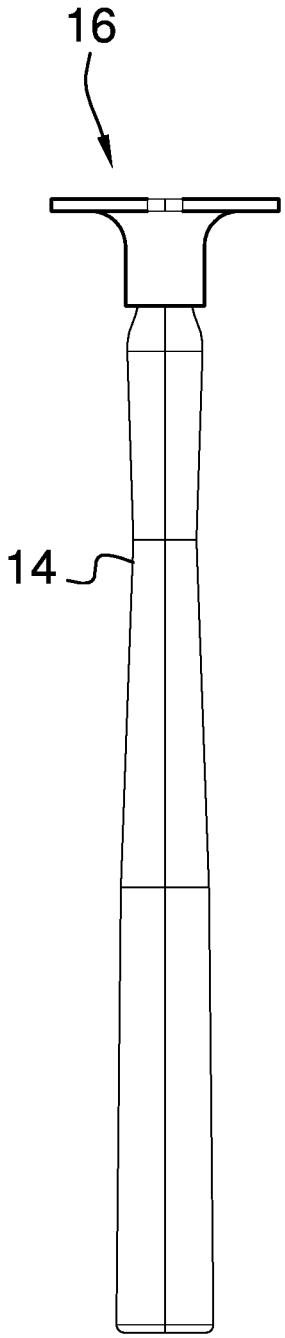
FIG. 4 is a front view of an embodiment of the disclosure.
Figure 5:
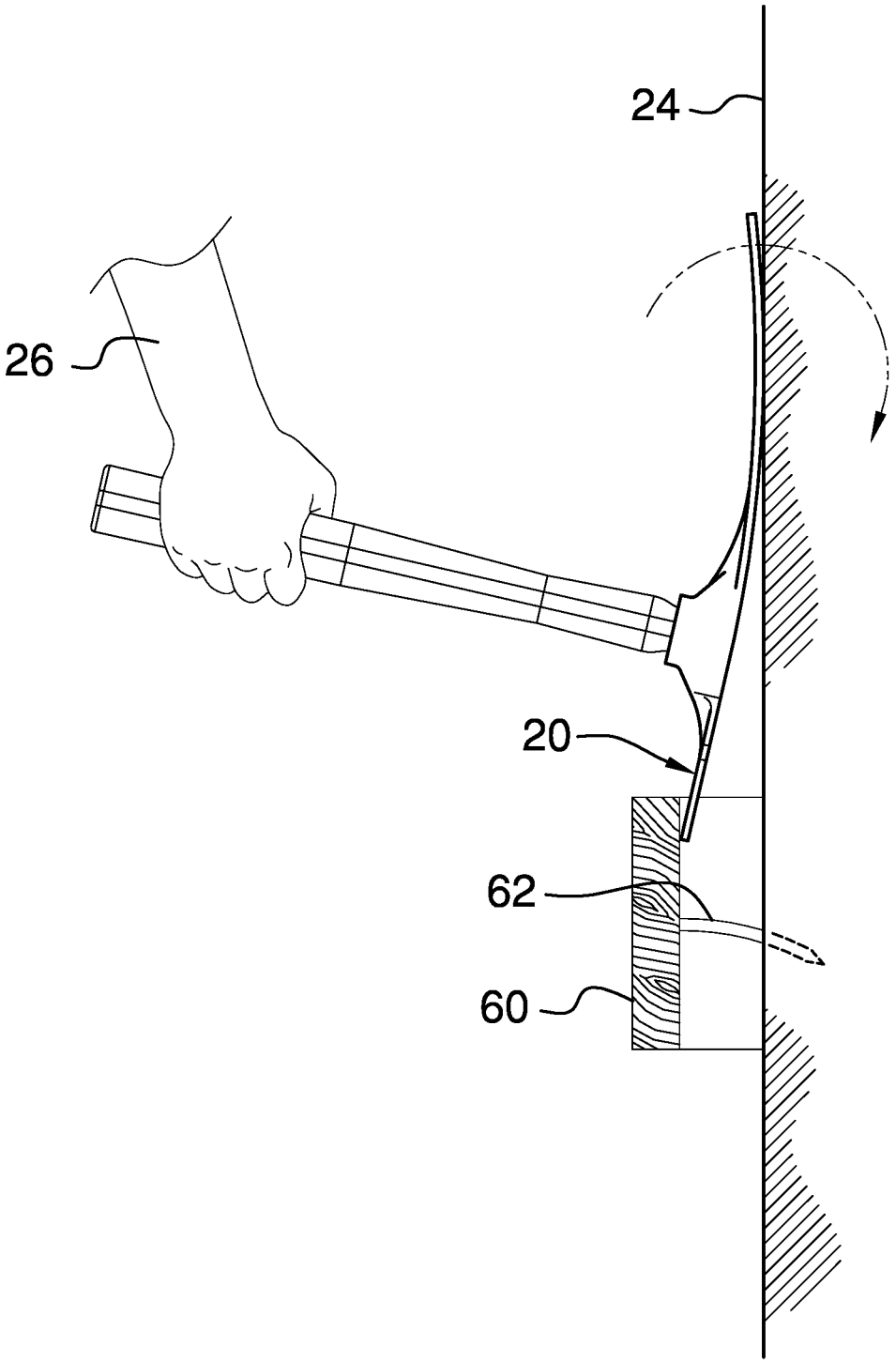
FIG. 5 is a perspective in-use view of an embodiment of the disclosure showing a chisel portion prying a board.
Figure 6:
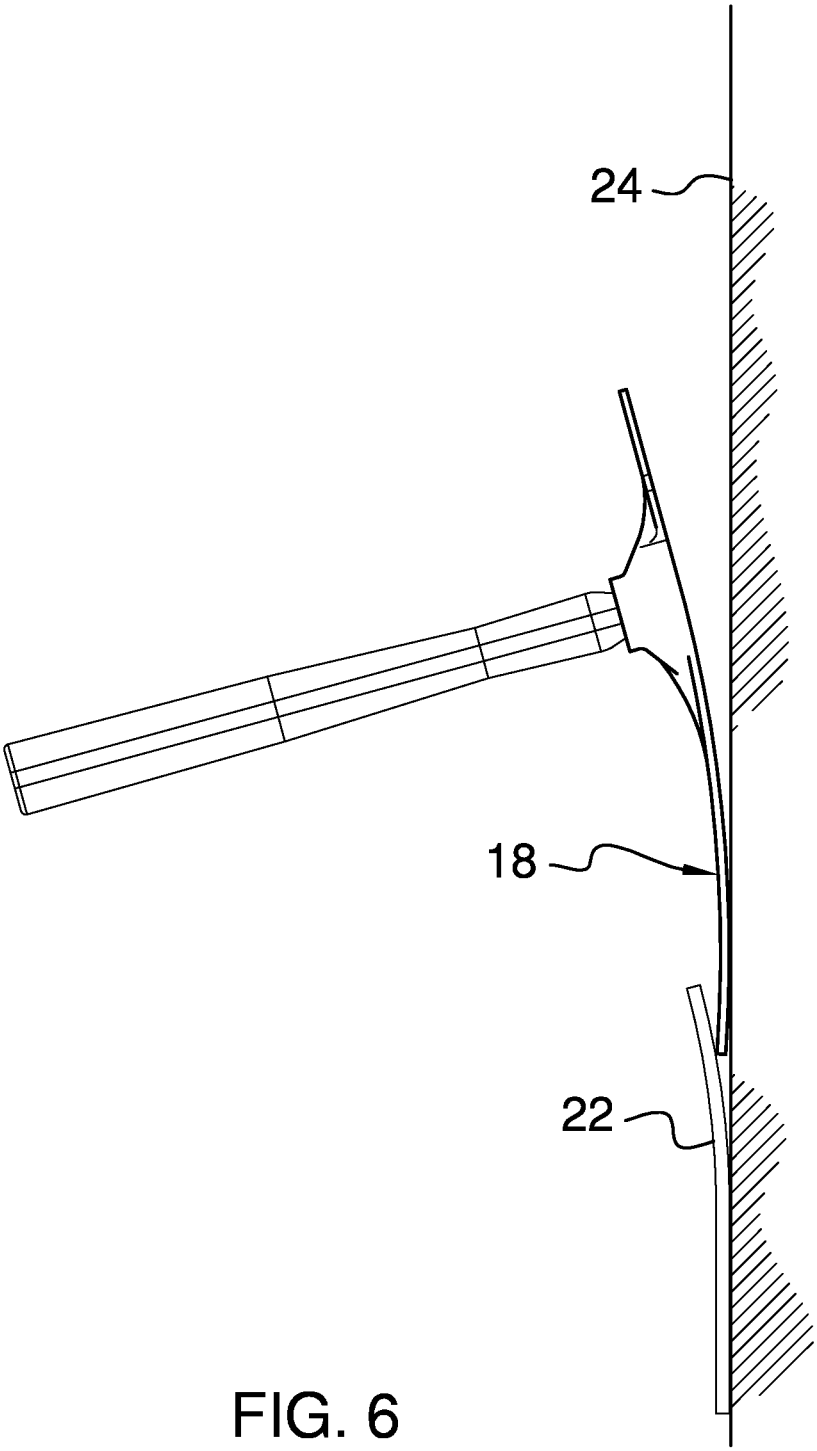
FIG. 6 is a perspective in-use view of an embodiment of the disclosure showing a claw portion prying a tile from a hard floor surface.

With reference now to the drawings, and in particular to FIGS. 1 through 6 thereof, a new tile removal device embodying the principles and concepts of an embodiment of the disclosure and generally designated by the reference numeral 10 will be described.

As best illustrated in FIGS. 1 through 6, the tile removal assembly 10 generally comprises a tool 12 that has a handle 14 and a head 16 attached to the handle 14. The head 16 has a claw portion 18 extending laterally away from the handle 14 and a chisel portion 20 extending laterally away from the handle 14 in an opposite direction from the claw portion 18. The claw portion 18 has a thickness that is sufficiently thin to facilitate the claw portion 18 to flex when the head 16 is swung toward a tile 22 that is bonded to a hard floor surface 24. In this way the claw portion 18 can travel between the tile 22 and the hard floor surface 24 without requiring a user 26 to swing the tool 12 with a high degree of accuracy. The chisel portion 20 has a thickness that is sufficiently thick to inhibit the chisel portion 20 from flexing thereby facilitating the chisel portion 20 to pry a fixed object. The claw portion 18 may have a length ranging between approximately 15.0 cm and 25.0 cm and the chisel portion 20 may have a length ranging between approximately 5.0 cm and 10.0 cm. Furthermore, the claw portion 18 may have a maximum thickness of approximately 3.0 mm and a minimum thickness of approximately 1.0 mm.

The handle 14 has an upper end 28, a lower end 30 and an outer surface 32 extending between the upper end 28 and the lower end 30, and the handle 14 is elongated between the upper end 28 and the lower end 30. The outer surface 32 has a bulbous portion 34 curving outwardly from an axis extending between the upper end 28 and the lower end 30, and the bulbous portion 34 is spaced from the upper end 28. The outer surface 32 gradually flares outwardly between the bulbous portion 34 and the lower end 30. The handle 14 may have a length ranging between approximately 25.0 cm and 35.0 cm.

The head 16 has a top surface 36, a bottom surface 38 and an outer edge 40 extending between the top surface 36 and the bottom surface 38, and the outer edge 40 has a first lateral side 42, a second lateral side 44, a back side 46 and a front side 48. The back side 46 is associated with the claw portion 18 and the front side 48 is associated with the chisel portion 20. The head 16 has a prominence 50 extending downwardly from the bottom surface 38 and the prominence 50 is positioned closer to the front side 48 than the back side 46 of the outer edge 40. Furthermore, the prominence 50 has a distal end 52 with respect to the bottom surface 38 and the distal end 52 is flattened. Each of the first lateral side 42 and the second lateral side 44 curve outwardly at the chisel portion 20 such that the chisel portion 20 has a width that is greater than the width of the claw portion 18.

The head 16 has a well 54 extending upwardly through the distal end 52 of the prominence 50 toward the top surface 36 of the head 16. The handle 14 extends into the well 54 such the bulbous portion 34 is spaced downwardly from the distal end 52 of the prominence 50. Additionally, the bulbous portion 34 has a diameter that is greater than a diameter of the well 54 such that the bulbous portion 34 inhibits the head 16 from sliding downwardly along the handle 14. The claw portion 18 curves downwardly toward the lower end 30 of the handle 14 between the prominence 50 and the back side 46 of the outer edge 40 and the claw portion 18 reduces in thickness between the prominence 50 and the back side 46. The chisel portion 20 lies on a flattened plane between the prominence 50 and the front side 48, and the chisel portion 20 has a uniform thickness between the prominence 50 and the front side 48 of the outer edge 40.

The front side 48 of the outer edge 40 has a notch 56 extending toward the prominence 50 thereby facilitating the notch 56 to engage a nail for pulling the nail. The notch 56 is centrally positioned along the front side 48 and the notch 56 has pair of bounding edges 58 intersecting each other at a point such that the notch 56 has a triangle shape. As is most clearly shown in FIG. 5, the tool 12 is positioned such that the top surface 36 associated with claw portion 18 rests on the hard floor surface 24 thereby facilitating the head 16 to be rocked on the top surface 36 of the claw portion 18. In this way the chisel portion 20 of the tool 12 can be employed for prying a board 60, for example, which has been nailed to the hard floor surface 24.

In use, the handle 14 is gripped and the handle 14 is swung in a downward arc to facilitate the claw portion 18 of the head 16 to be driven beneath a tile 22 and the hard floor surface 24. Additionally, the flexibility of the claw portion 18 facilitates the claw portion 18 to flex when the claw portion 18 strikes the hard floor surface 24 thereby facilitating the claw portion 18 to pass beneath the tile 22. The handle 14 is subsequently pushed away from the tile 22 to facilitate the claw portion 18 to urge to tile 22 upwardly to dislodge the tile 22 from the hard floor surface 24. The chisel portion 20 can be driven beneath a board 60, for example, which is fastened with a nail to pry the board loose. The notch 56 in the chisel portion 20 can be positioned against a nail 62 to pry the nail 62 upwardly and remove the nail 62 from a surface in which the nail 62 had previously been driven.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tile removal assembly for removing tile panels from a hard floor surface, said assembly comprising:

a tool having a handle and a head attached to said handle, said head having a claw portion extending laterally away from said handle and a chisel portion extending laterally away from said handle in an opposite direction from said claw portion, said claw portion having a thickness being sufficiently thin to facilitate said claw portion to flex when said head is swung toward a tile being bonded to a hard floor surface thereby facilitating said claw portion to travel between the tile and the hard floor surface wherein said claw portion is configured to facilitate a user to drive said claw portion beneath the tile without requiring the user to swing said tool with a high degree of accuracy, said chisel portion having a thickness being sufficiently thick to inhibit said chisel portion from flexing thereby facilitating said chisel portion to pry a fixed object.

2. The assembly according to claim 1, wherein said handle has an upper end, a lower end and an outer surface extending between said upper end and said lower end, said handle being elongated between said upper end and said lower end, said outer surface having a bulbous portion curving outwardly from an axis extending between said upper end and said lower end, said bulbous portion being spaced from said upper end, said outer surface gradually flaring outwardly between said bulbous portion and said lower end.

3. The assembly according to claim 2, wherein:

said head has a top surface, a bottom surface and an outer edge extending between said top surface and said bottom surface, said outer edge having a first lateral side, a second lateral side, a back side and a front side, said back side being associated with said claw portion, said front side being associated with said chisel portion;

said head has a prominence extending downwardly from said bottom surface, said prominence being positioned closer to said front side than said back side of said outer edge, said prominence having a distal end with respect to said bottom surface, said distal end being flattened;

said head has a well extending through said distal end of said prominence toward said top surface.

4. The assembly according to claim 3, wherein said handle extends into said well such that said bulbous portion is spaced downwardly from said distal end of said prominence, said bulbous portion having a diameter being greater than a diameter of said well such that said bulbous portion inhibits said head from sliding downwardly along said handle.

5. The assembly according to claim 3, wherein:

said claw portion curves downwardly toward said lower end of said handle between said prominence and said back side of said outer edge, said claw portion reducing in thickness between said prominence and said back side; and said chisel portion lies on a flattened plant between said prominence and said front side, said chisel portion having a uniform thickness between said prominence and said front side of said outer edge.

6. The assembly according to claim 3, wherein said front side of said outer edge has a notch extending toward said prominence thereby facilitating said notch to engage a nail for pulling the nail, said notch being centrally positioned along said front side, said notch having pair of bounding edges intersecting each other at a point such that said notch has a triangle shape.

7. A tile removal assembly for removing tile panels from a hard floor surface, said assembly comprising:

a tool having a handle and a head attached to said handle, said head having a claw portion extending laterally away from said handle and a chisel portion extending laterally away from said handle in an opposite direction from said claw portion, said claw portion having a thickness being sufficiently thin to facilitate said claw portion to flex when said head is swung toward a tile being bonded to a hard floor surface thereby facilitating said claw portion to travel between the tile and the hard floor surface wherein said claw portion is configured to facilitate a user to drive said claw portion beneath the tile without requiring the user to swing said tool with a high degree of accuracy, said chisel portion having a thickness being sufficiently thick to inhibit said chisel portion from flexing thereby facilitating said chisel portion to pry a fixed object, said handle having an upper end, a lower end and an outer surface extending between said upper end and said lower end, said handle being elongated between said upper end and said lower end, said outer surface having a bulbous portion curving outwardly from an axis extending between said upper end and said lower end, said bulbous portion being spaced from said upper end, said outer surface gradually flaring outwardly between said bulbous portion and said lower end, said head having a top surface, a bottom surface and an outer edge extending between said top surface and said bottom surface, said outer edge having a first lateral side, a second lateral side, a back side and a front side, said back side being associated with said claw portion, said front side being associated with said chisel portion, said head having a prominence extending downwardly from said bottom surface, said prominence being positioned closer to said front side than said back side of said outer edge, said prominence having a distal end with respect to said bottom surface, said distal end being flattened, said head having a well extending through said distal end of said prominence toward said top surface, said handle extending into said well such that said bulbous portion is spaced downwardly from said distal end of said prominence, said bulbous portion having a diameter being greater than a diameter of said well such that said bulbous portion inhibits said head from sliding downwardly along said handle, said claw portion curving downwardly toward said lower end of said handle between said prominence and said back side of said outer edge, said claw portion reducing in thickness between said prominence and said back side, said chisel portion lying on a flattened plant between said prominence and said front side, said chisel portion having a uniform thickness between said prominence and said front side of said outer edge, said front side of said outer edge having a notch extending toward said prominence thereby facilitating said notch to engage a nail for pulling the nail, said notch being centrally positioned along said front side, said notch having pair of bounding edges intersecting each other at a point such that said notch has a triangle shape.

* * * * *